US008051825B2

(12) United States Patent
Lester et al.

(10) Patent No.: US 8,051,825 B2
(45) Date of Patent: Nov. 8, 2011

(54) THROUGH-BOLTED ROCKER BAR ASSEMBLY

(75) Inventors: Nicholas Patrick Lester, Greenfield, IN (US); Dan L. Alden, Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 554 days.

(21) Appl. No.: 12/204,167

(22) Filed: Sep. 4, 2008

(65) Prior Publication Data

US 2010/0050974 A1 Mar. 4, 2010

(51) Int. Cl.
*F01L 1/18* (2006.01)

(52) U.S. Cl. ..... 123/193.5; 123/90.39

(58) Field of Classification Search .... 123/90.39–90.47, 123/193.5

See application file for complete search history.

(56) References Cited

U.S. PATENT DOCUMENTS

| | | | | |
|---|---|---|---|---|
| 4,944,257 | A * | 7/1990 | Mills | 123/90.39 |
| 5,005,544 | A * | 4/1991 | Spangler | 123/195 R |
| 5,806,475 | A * | 9/1998 | Hausknecht | 123/90.16 |
| 2004/0182347 | A1 * | 9/2004 | Curtis | 123/90.41 |
| 2005/0199205 | A1 * | 9/2005 | Curtis | 123/90.43 |
| 2007/0044745 | A1 * | 3/2007 | Smith | 123/90.41 |
| 2007/0227485 | A1 * | 10/2007 | Tores et al. | 123/90.41 |

* cited by examiner

*Primary Examiner* — M. McMahon

(74) *Attorney, Agent, or Firm* — Harness, Dickey & Pierce, P.L.C.

(57) ABSTRACT

An engine assembly may include an engine block, a cylinder head, and a valvetrain assembly. The cylinder head may be fixed to the engine block. The valvetrain assembly may include a valve actuating member, a support member, and a first fastener engaged with the support member and the engine block that fixes the support member to the engine block. The valve actuating member may be rotatably supported on the support member.

15 Claims, 3 Drawing Sheets

THROUGH-BOLTED ROCKER BAR ASSEMBLY

FIELD

The present disclosure relates to engine valvetrain assemblies and more specifically to the fixation of valvetrain assemblies to an engine.

BACKGROUND

The statements in this section merely provide background information related to the present disclosure and may not constitute prior art.

Engine valvetrains may include rocker bar assemblies that rotatably support valve actuating devices such as rocker arms. Engine rocker bar assemblies may be fixed to a cylinder head of an engine through a bolted engagement. However, the load applied to the rocker bar assemblies by the valve actuating devices may exceed the load that the cylinder head mounting location can withstand.

SUMMARY

An engine assembly may include an engine block, a cylinder head, and a valvetrain assembly. The cylinder head may be fixed to the engine block. The valvetrain assembly may include a valve actuating member, a support member, and a first fastener engaged with the support member and the engine block that fixes the support member to the engine block. The valve actuating member may be rotatably supported on the support member.

Additionally, the cylinder head may be located between the support member and the engine block and the first fastener may extend through the cylinder head to engage the engine block. The valvetrain assembly may include a second fastener having a threaded region and the cylinder head may include a threaded bore engaged with the threaded region of the second fastener.

A valvetrain assembly may include a support member, a valve actuating mechanism, and a first fastener. The valve actuating member may be rotatably supported on the support member. The first fastener may extend through a cylinder head of an engine and engage an engine block of the engine to fix the support member to the engine block.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
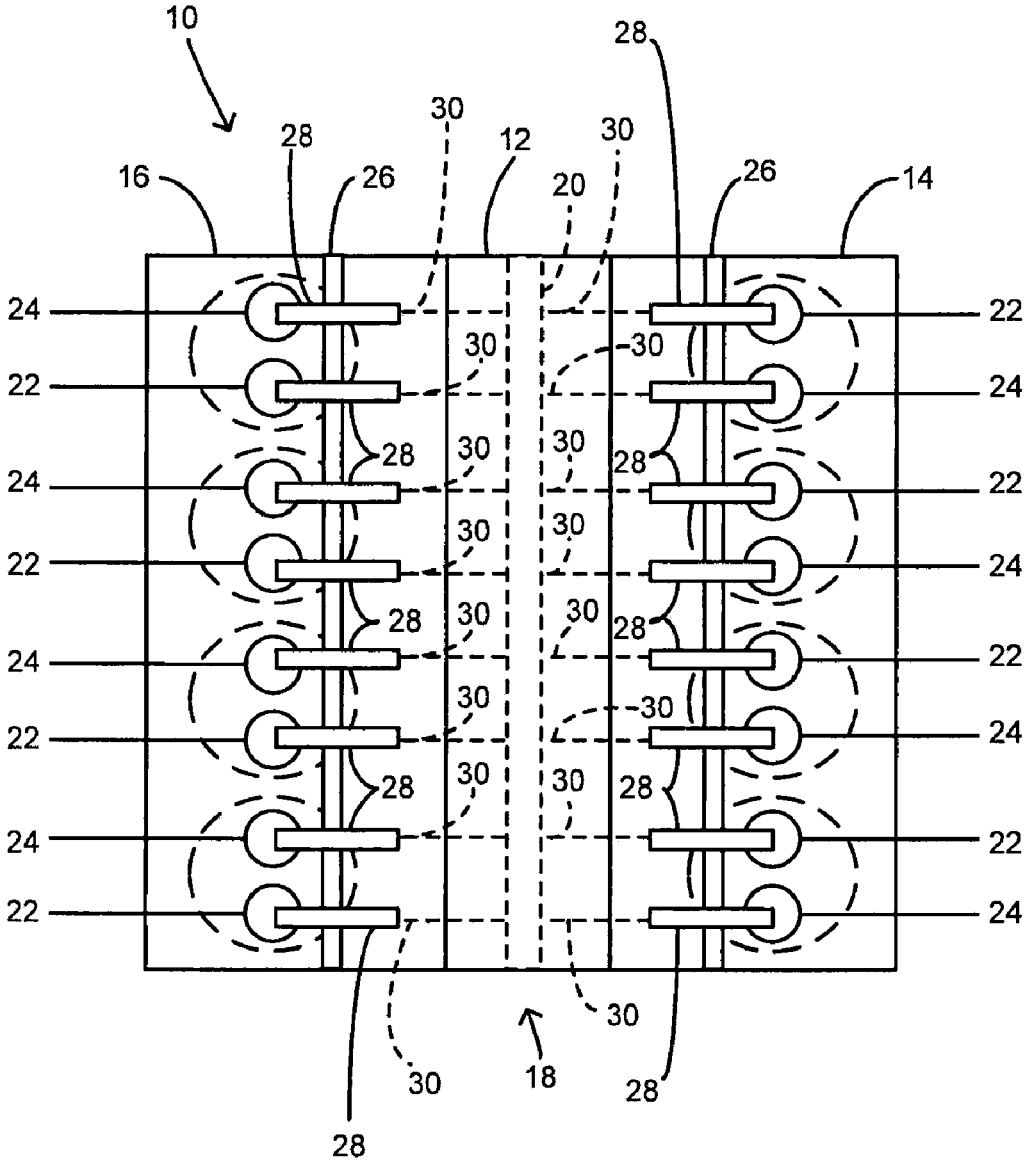
FIG. 1 is a schematic illustration of an engine assembly according to the present disclosure.

The following description is merely exemplary in nature and is not intended to limit the present disclosure, application, or uses. It should be understood that throughout the drawings, corresponding reference numerals indicate like or corresponding parts and features.

Figure 2:
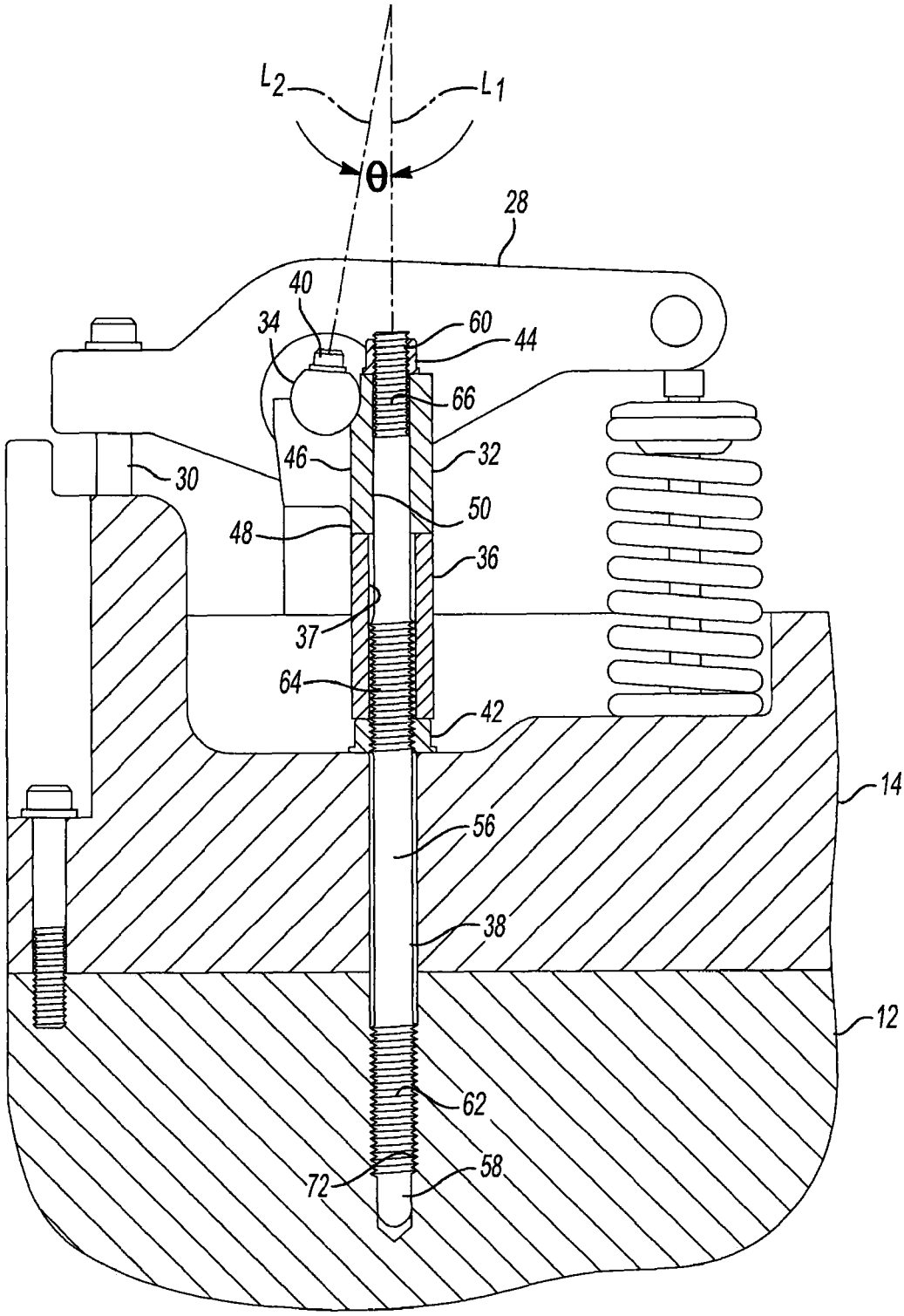
FIG. 2 is a fragmentary section view of the engine assembly of FIG. 1.
Figure 3:
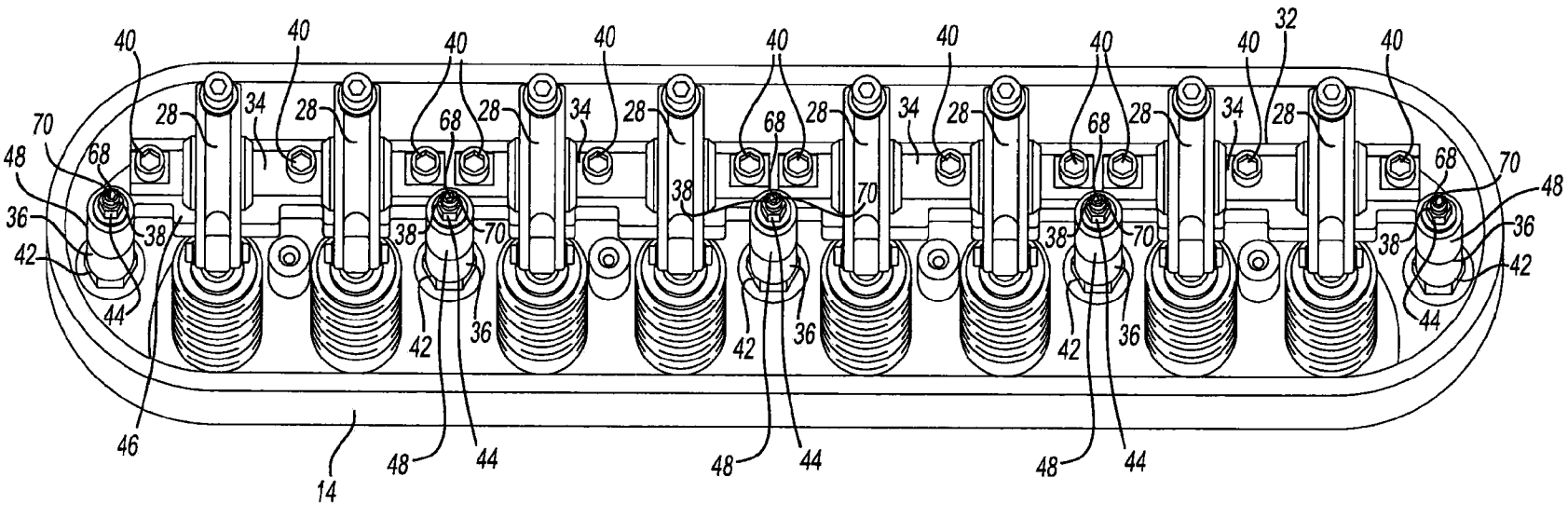
FIG. 3 is a fragmentary perspective view of the engine assembly of FIG. 1.

Referring now to FIGS. 1-3, an exemplary engine assembly 10 is schematically illustrated. The engine assembly 10 may include an engine block 12, first and second cylinder heads 14, 16, and a valvetrain assembly 18. The valvetrain assembly 18 may include a camshaft 20, intake and exhaust valves 22, 24, rocker bar assemblies 26, valve actuating assemblies 28, and pushrods 30. The pushrods 30 may be engaged with the camshaft 20 and the valve actuating assemblies 28 to selectively open the intake and exhaust valves 22, 24.

The rocker bar assemblies 26 may form a support member for the valve actuating assemblies 28 and may include a support bar 32, rocker shafts 34, spacers 36, a set of first fasteners 38, a set of second fasteners 40, and first and second sets of nuts 42, 44. The valve actuating assemblies 28 may take a variety of forms. In the present example, the valve actuating assemblies 28 are in the form of rocker arms.

The valvetrain assembly 18 associated with each of the first and second cylinder heads 14, 16 may be generally similar to one another. Therefore, the valvetrain assembly 18 will be described with respect to the first cylinder head 14 with the understanding that the description applies equally to the second cylinder head 16. The support bar 32 may be fixed to the first cylinder head 14 and the engine block 12 and may include a main body portion 46 having a series of legs 48 extending from the main body portion 46.

A first set of openings 50 may extend through the main body portion 46 and the legs 48 and a second set of openings (not shown) may extend through the main body portion 46. The second set of openings may be offset from and disposed at an angle relative to the first set of openings 50. The rocker shafts 34 may include a series of openings (not shown) aligned with the second set of openings in the support bar 32. The rocker shafts 34 may each support a first and second valve actuating assembly 28 and may be fixed to the support bar 32.

Each of the first fasteners 38 may include a shaft 56 having first and second ends 58, 60. The shaft 56 may include a first threaded region 62 near the first end 58, a second threaded region 64 at an intermediate portion, and a third threaded region 66 at the second end 60. The second end 60 may additionally include a recess 68 extending axially into the shaft 56, as illustrated in FIG. 3. The recess 68 may include a series of flats 70, for a pattern, such as a hexagonal pattern, for engagement with a driver.

The spacers 36 may include an unthreaded bore 37 and may be located between the legs 48 of the support bar 32 and the first cylinder head 14. A first fastener 38 may be located at each end of the support bar 32, as well as between pairs of intake and exhaust valves 22, 24. The engagement between one of the first fasteners 38, the support bar 32, the first cylinder head 14, and the engine block 12 will be discussed below with the understanding that the description applies equally to the remainder of the first fasteners 38. The first fastener 38 may extend through the first set of openings 50 in the support bar 32, the spacer 36, the first cylinder head 14, and the engine block 12. More specifically, the engine block 12 may include a threaded bore 72 engaged with the first threaded region 62 of the first fastener 38.

The second threaded region 64 may be located between the spacer 36 and the first cylinder head 14. The second threaded region 64 may be engaged with the first nut 42 and the first nut 42 may abut the first cylinder head 14. The first cylinder head 14 may be fixed to the engine block 12 by the engagement between the first fastener 38 and the engine block 12 and the engagement between the first nut 42 and the first cylinder head 14.

The second end 60 of the first fastener 38 may extend through the first opening 50 and above the support bar 32. More specifically, the third threaded region 66 may extend above the support bar 32 and may be engaged with the second nut 44. The second nut 44 may abut the support bar 32 and may cooperate with the first fastener 38 to directly couple the rocker bar assembly 26 to the engine block 12. In the present example, the first fastener 38 may be free from threaded engagement with the first cylinder head 14.

The set of second fasteners 40 may extend through the second set of openings in the support bar 32 and the openings in the rocker shaft 34 and may be engaged with the first cylinder head 14. The engagement between the set of second fasteners 40 and the first cylinder head 14 may include a threaded engagement between the second fastener 40 and a threaded bore (not shown) of the first cylinder head 14. A longitudinal axis (L1) of the first fastener 38 may extend at an angle (θ) relative to the longitudinal axis (L2) of the second fastener 40. The angular disposition of the first and second fasteners 38, 40 relative to one another may provide increased structural support for the load applied to the rocker bar assembly 26 by the valve actuating assemblies 28.

During assembly, the first fastener 38 may be placed through the cylinder head 14 and into the engine block 12. The first threaded region 62 of the first fastener 38 may be threaded into the threaded bore 72 of the engine block 12. Next, the first nut 42 may be threaded onto the second threaded region 64 of the first fastener 38 to fix the cylinder head 14 to the engine block 12. The spacer 36 may then be slid onto the first fastener 38. Next, the support bar 32 may be located on the first fastener 38. The second nut 44 may then be threaded onto the third threaded region 66 of the first fastener 38 to fix the rocker bar assembly 26 to the engine block 12. The second fastener 40 may then be located in the support bar 32 and the rocker shaft 34 and threaded into the cylinder head 14.

What is claimed is:

1. An engine assembly comprising:

an engine block;

a cylinder head fixed to the engine block; and a valvetrain assembly including a first valve actuating member, a second valve actuating member, a support member including a support bar and first and second rocker shafts fixed to the support bar, a first fastener engaged with the support bar and the engine block that fixes the support bar to the engine block, and a second fastener engaged with the first rocker shaft and having a threaded region, the cylinder head including a threaded bore engaged with the threaded region of the second fastener, a first longitudinal axis of the first fastener being disposed at an angle relative to a second longitudinal axis of the second fastener and the first longitudinal axis intersecting the second longitudinal axis, and the first valve actuating member being rotatably supported on the first rocker shaft and the second valve actuating member being rotatably supported on the second rocker shaft.

2. The engine assembly of claim 1, wherein the cylinder head is located between the support member and the engine block, the first fastener extending through the cylinder head to engage the engine block.

3. The engine assembly of claim 2, wherein the engine block includes a first threaded bore and the first fastener includes a first threaded region engaged with the first threaded bore.

4. The engine assembly of claim 3, wherein the valvetrain assembly includes a first nut abutting the cylinder head and having a second threaded bore, the first fastener having a second threaded region engaged with the second threaded bore, the cylinder head being located between the first nut and the engine block and being fixed to the engine block by the first fastener and the first nut.

5. The engine assembly of claim 1, wherein the actuating member includes a rocker arm assembly.

6. The engine assembly of claim 1, wherein the first fastener is located at a first longitudinal end of the support member.

7. The engine assembly of claim 6, further comprising a third fastener located at a second longitudinal end of the support member and engaged with the support bar and the engine block.

8. An engine assembly comprising:

an engine block;

a cylinder head fixed to the engine block and including a threaded bore; and a valvetrain assembly including a valve actuating member, a support member including a support bar and a first rocker shaft, and first and second fasteners, the cylinder head being located between the support member and the engine block and the first fastener engaged with the support bar and extending through the cylinder head and engaged with the engine block to fix the support bar to the engine block, the second fastener engaged with the first rocker shaft and having a threaded region engaged with the threaded bore of the cylinder head, a first longitudinal axis of the first fastener being disposed at an angle relative to a second longitudinal axis of the second fastener and the first longitudinal axis intersecting the second longitudinal axis, and the valve actuating member being rotatably supported on the first rocker shaft.

9. The engine assembly of claim 8, wherein the engine block includes a threaded bore and the first fastener includes a threaded region engaged with the threaded bore of the engine block.

10. A valvetrain assembly comprising:

a support member including a support bar and first and second rocker shafts fixed to the support bar;

a first valve actuating member rotatably supported on the first rocker shaft;

a second valve actuating member rotatably supported on the second rocker shaft;

a first fastener adapted to extend through a cylinder head of an engine and engage an engine block of the engine to fix the support bar to the engine block; and a second fastener having a threaded region adapted to engage the cylinder head, a first longitudinal axis of the first fastener being disposed at an angle relative to a second longitudinal axis of the second fastener and the first longitudinal axis intersecting the second longitudinal axis.

11. The valvetrain assembly of claim 10, wherein the first fastener includes a shaft having a first threaded region, the shaft adapted to extend through the cylinder head and the first threaded region adapted to engage the engine block.

12. The valvetrain assembly of claim 11, further comprising a first nut having a threaded bore, the first fastener having a second threaded region engaged with the threaded bore, the first nut and the first fastener adapted to fix the cylinder head to the engine block.

13. The valvetrain assembly of claim 10, wherein the first and second valve actuating members include rocker arm assemblies.

14. The valvetrain assembly of claim 10, wherein the first fastener is located at a first longitudinal end of the support member.

15. The valvetrain assembly of claim 14, further comprising a third fastener located at a second longitudinal end of the support member.

* * * * *